US006334921B1

(12) United States Patent
Duschek

(10) Patent No.: US 6,334,921 B1
(45) Date of Patent: Jan. 1, 2002

(54) APPARATUS AND METHOD FOR MANUFACTURING LABELS FOR ELECTRONIC ARTICLE SURVEILLANCE

(75) Inventor: Detlef Duschek, Sensbachtal (DE)

(73) Assignee: Meto International GmbH, Hirschhorn (DE)

( * ) Notice: Subject to any disclaimer, the term of this patent is extended or adjusted under 35 U.S.C. 154(b) by 0 days.

(21) Appl. No.: 09/337,467

(22) Filed: Jun. 21, 1999

(30) Foreign Application Priority Data

Jun. 20, 1998 (DE) ..... 198 27 592

(51) Int. Cl.[7] ..... B44C 1/165; B32B 31/10

(52) U.S. Cl. ..... 156/230; 156/238; 156/247; 156/540; 156/152; 156/DIG. 28; 156/DIG. 31; 156/DIG. 33; 156/DIG. 45

(58) Field of Search ..... 156/230, 238, 156/244.18, 247, 540, 541, 543, 567, 512, 152, 584, DIG. 28, DIG. 31, DIG. 1, DIG. 33, DIG. 39, DIG. 40, DIG. 45, DIG. 25

(56) References Cited

U.S. PATENT DOCUMENTS

| | | | | |
|---|---|---|---|---|
| 3,489,638 A | | 1/1970 | Collons | 156/584 |
| 4,475,969 A | | 10/1984 | Reed | 156/152 |
| 5,167,752 A | * | 12/1992 | Dowling | 156/512 |
| 5,660,663 A | * | 8/1997 | Chamberlain et al. | 156/152 |
| 5,867,102 A | * | 2/1999 | Souder et al. | 340/572 |

FOREIGN PATENT DOCUMENTS

| | | |
|---|---|---|
| DE | 2063483 | 7/1972 |
| DE | 3203162 A1 | 8/1983 |
| DE | 3223477 A1 | 12/1983 |
| DE | 19650611 A1 | 6/1998 |
| EP | 0682333 A1 | 11/1995 |
| GB | 1448014 | 9/1976 |
| GB | 2303613 | 2/1997 |
| WO | WO 95/23687 | 9/1995 |
| WO | WO 97/14126 | 4/1997 |

* cited by examiner

*Primary Examiner*—Richard Crispino
*Assistant Examiner*—J. A. Lorengo
(74) *Attorney, Agent, or Firm*—Jones, Tullar & Cooper, P.C.

(57) ABSTRACT

The present invention relates to an apparatus for manufacturing labels for electronic article surveillance, comprising a label repositioner which by means of a first dispensing edge removes the labels from a carrier web and by means of a second dispensing edge places them in a predetermined position on the same or a different carrier web, and an applicator unit for applying security elements to the carrier web. The applicator unit is constructed to apply the security elements continuously to the carrier web, whereby at least one security element is allocated to each label or to any number of labels.

11 Claims, 2 Drawing Sheets

APPARATUS AND METHOD FOR MANUFACTURING LABELS FOR ELECTRONIC ARTICLE SURVEILLANCE

FIELD OF THE INVENTION

This invention relates to an apparatus for manufacturing labels for electronic article surveillance. The label comprises a label repositioner which by means of a first dispensing edge removes the labels from a carrier web and by means of a second dispensing edge places them in a predetermined position on the same or a different carrier web. The present invention also relates to an applicator unit for applying security elements to the carrier web. Furthermore, the invention and to a method for manufacturing labels for electronic article surveillance.

BACKGROUND OF THE INVENTION

From Published International Application WO 97/14126 there is already known a method and an apparatus for combining security elements with labels. After the labels are delaminated from the carrier web, the web is guided in a loop around the delaminating station. Then the labels are put back onto the same carrier web at a predetermined relative distance.

Within the loop formed by the carrier web, security elements are placed in succession on the carrier web so that later they lie between the repositioned labels and the carrier web. The security elements are applied to the carrier web intermittently by means of a dispensing edge. The security elements are pressed onto the carrier web preferably by means of blast air. A disadvantage of the known apparatus is its relatively low speed of production due to the intermittent operating mode of the blast air applicators.

It should be noted that a further apparatus for incorporating security elements in a strip of labels is also known from German Patent DE 44 36 284 A1.

SUMMARY OF THE INVENTION

It is an object of the present invention to provide an apparatus and a method with which the production of labels for electronic article surveillance can be accelerated.

With respect to the apparatus, this object is accomplished in that the applicator unit is constructed to apply the security elements continuously to the carrier web, whereby at least one security element is allocated to each label or to any number of labels. The solution of the present invention enables the production process to be accelerated at will because a continuous application of the security elements to the carrier web, onto which the labels are subsequently placed, likewise continuously, can be performed substantially more quickly and easily than an intermittent feeding involving a step by step movement of the carrier web to the next position.

It is possible, of course, to use all the known types of security element, for example, soft magnetic security elements, resonant frequency security elements, acousto-magnetic security elements etc., as security elements. To enable the labels to be delaminated from the carrier web without difficulty, the adhesive force between the adhesive material and the labels is greater than the adhesive force between the adhesive material and the carrier web.

According to an advantageous further aspect of the apparatus of this invention, the applicator unit is comprised of the following sub-elements: an application cylinder, on which the security elements are fixed by vacuum or magnets, and a further applicator.

While a vacuum application cylinder can be used completely irrespectively of the nature of the security elements needing to be dispensed, it will be obvious that an application cylinder based on magnetic attraction is suitable only for applying magnetic security elements.

Considering that it should be possible to use the apparatus according to the present invention for the application of security elements and labels of completely different dimensions, a favorable aspect provides for a regulating/controlling device which guarantees that the security elements are positioned correctly in relation to the labels. The apparatus should also be able in particular to equip not every label but only a selected number of labels with security elements. For example, it is desirable that the apparatus be able to equip only every fourth label on a strip of labels with a security element. An accordingly designed label strip is already described in European Patent EP 0 682 333 A1.

A preferred aspect of the apparatus of the present invention provides for the applicator to be comprised of the following sub-elements: a supply roll on which a carrier web supporting the security elements is wound, a dispensing edge over which the security elements are transferred to the application cylinder, and at least one sensor which detects the relative distance of the individual security elements and their length.

To enable the security elements to be readily applied to the application cylinder, provision is made for an adhesive between the carrier web and the security elements whose adhesive force relative to the carrier web is smaller than the force of attraction/suction exerted by the application cylinder on the security elements. It is also possible, of course, to construct the apparatus of the present invention in such a way as to enable several labels arranged side by side on the carrier web to be equipped simultaneously with security elements. This simply requires the corresponding cylinders to be suitably dimensioned.

In an advantageous further aspect of the apparatus of the present invention, a first sensor is proposed which detects the relative distance of the labels on the carrier web; a second sensor detects the relative distance of the security elements on the carrier web, while a third sensor is assigned to the application cylinder and detects the relative distance of the security elements fixed on the application cylinder. This data is made available to the controlling/regulating device which can use it to set the relative speed between the speed at which the security elements are fed by the applicator unit and the peripheral speed of the application cylinder so that the security elements are applied to any desired point on the application cylinder and subsequently to the carrier web. Hence it is possible for any number of labels to be equipped exactly with at least one security element. Furthermore, provision is made in particular for the controlling/regulating device to adapt the peripheral speed of the application cylinder to the running speed of the carrier web.

Still further, the controlling/regulating device sets the peripheral speed of the applicator's supply roll so that the security elements are put on the application cylinder at a desired relative distance and are then transferred to the carrier web to be subsequently positioned under the desired number of labels.

The supply roll and the application cylinder are each allocated an angle transmitter and a motor to enable them to be controlled correctly.

If, at an identical speed of application cylinder and carrier web, the measurement values supplied by the sensors indicate that corrections have to be made to the position of the security elements in relation to the carrier web, the controlling/regulating device will vary the peripheral speed of the application cylinder accordingly so that the security elements on the application cylinder have the predetermined relative distance. Accordingly, after carrier web and labels are laminated together, the security elements are again positioned under the desired number of labels in the predetermined area of a label.

As regards the method for manufacturing labels for electronic article surveillance, the object of the present invention is accomplished as follows: the labels are removed from the carrier web by means of a first dispensing edge and put back onto the same or a different carrier web in a predetermined position by means of a second dispensing edge; the security elements are removed from a second carrier web by means of a further dispensing edge and transferred continuously by an application cylinder to the first carrier web so that, after carrier web and labels are laminated together, at least one security element is allocated to a desired number of labels.

The present invention will be explained in more detail in the following with reference to the accompanying drawing.

DESCRIPTION OF THE PREFERRED EMBODIMENT

Figure 1:
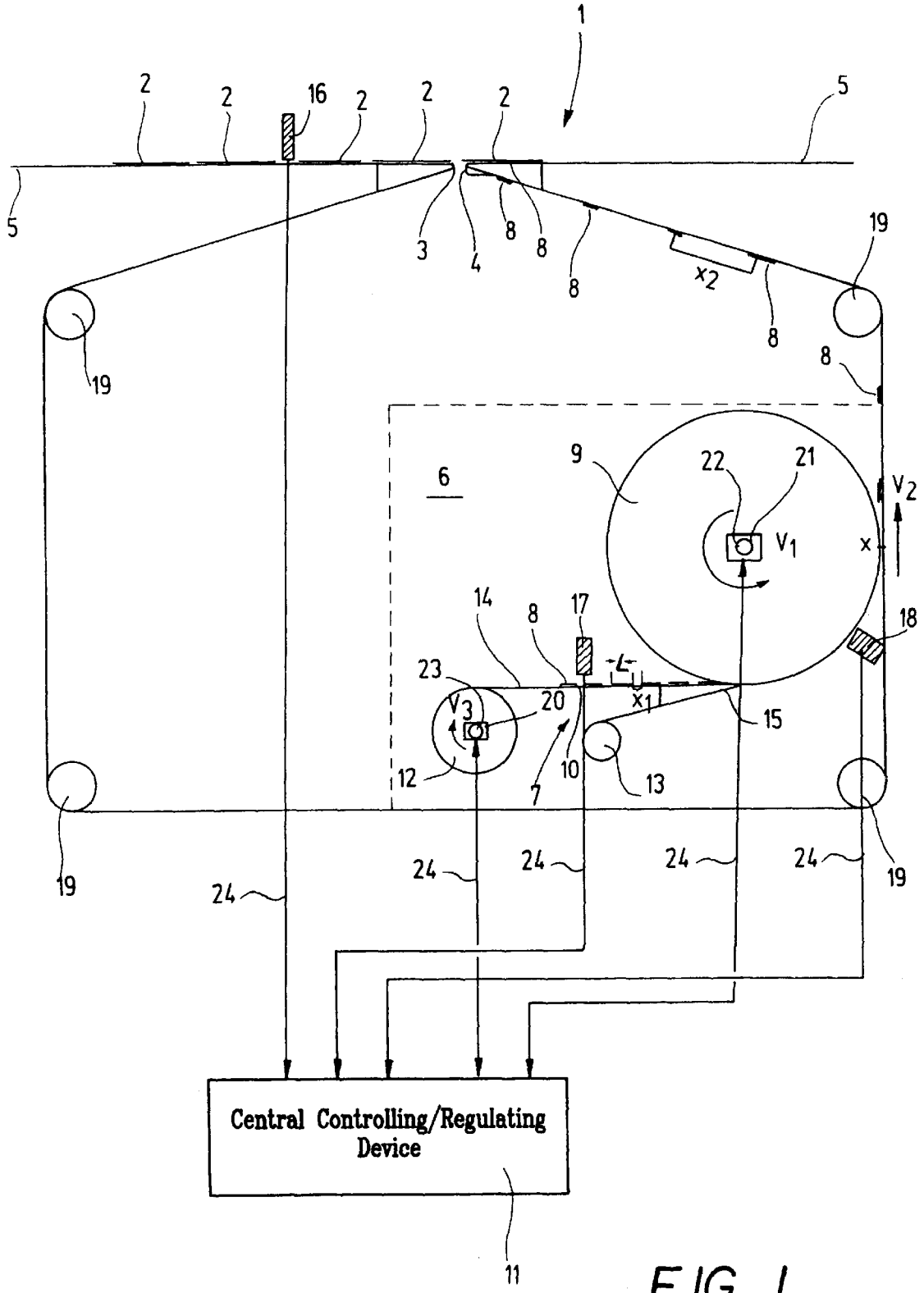
FIG. 1 is a representation of an advantageous embodiment of the apparatus of the present invention.

FIG. 1 is a representation of an advantageous embodiment of the apparatus of the present invention, in particular of the label repositioner 1 of the present invention. The label repositioner 1 is itself comprised essentially of two dispensing edges 3, 4.

The carrier web 5 on which the adhesive labels 2 are arranged is wound off a supply roll, not specially illustrated. The labels 2 are delaminated from the carrier web 5 at the dispensing edge 3. The carrier web 5 is guided downwards over the dispensing edge 3 and moved by means of guide rollers 19 in a loop to the dispensing edge 4, which is arranged nearly coplanar with the dispensing edge 3 and in its direct vicinity. The labels 2 are put back onto the carrier web 5 at the dispensing edge 4. It is not necessary, of course, for it to be the same carrier web 5; a different carrier web 5 can be used just as readily. The advantage of using one carrier web 5—in addition to saving material—is that only one sensor 16 is needed to determine the position of the labels 2 on the carrier web 5, and only one angle transmitter and one drive mechanism are needed for the supply and/or take-up roll. The angle transmitter, the motor, the supply roll and the take-up roll are not specially illustrated in FIG. 1.

The security elements 8 are applied by the applicator unit 6 to the carrier web 5. The applicator unit 6 is comprised of a supply roll 12, a dispensing edge 15 and a take-up roll 13. The security elements 8 are placed via the dispensing edge 15 with the desired relative distance onto the perforated peripheral surface of the application cylinder 9, where they are fixed in place by means of suction generated by a vacuum source, not specially illustrated. The carrier web 14 is pulled down at the dispensing edge 15 and wound onto the take-up roll 13.

Preferably the peripheral speed v1 of the application cylinder 9 corresponds to the running speed v2 of the carrier web 5. The peripheral speed v3 of the supply roll 12, on which the carrier web 14 with the adhesive security elements 8 is wound, is set as a function of the length L and the relative distance x1 of the security elements 8 via the angle transmitter 20 and the motor 22 in such fashion that the security elements 8 are applied to the application cylinder 9 at the desired relative distance x2 and then placed in the desired positions on the carrier web 5. The relative distance of the security elements 8 on the carrier web 5 is calculated so that, after the carrier web 5 and the labels 2 are laminated together, one security element 8 is positioned under the predetermined number of labels 2. In the embodiment illustrated, one security element 8 is applied under each label 2.

The sensors 16, 17, 18 which detect the relative position of the labels 2 and the security elements 8, respectively supply their measurement data to the central controlling/regulating device 11. Alternatively or in addition, angle transmitters 20, 21 are provided on the axles of the supply roll 12 and the application cylinder 9, respectively, to supply data concerning the respective angular position and hence the peripherals speeds v3, v1 of the roll 12 and the cylinder 9, respectively. This data is transmitted likewise to the controlling/regulating device 11. Using this data, particularly in conjunction with the length L and the relative distance x1 of the security elements 8 and labels 2 to be dispensed, the controlling/regulating device 11 determines the respective peripheral speeds of the supply roll 12 and, where applicable, the application cylinder 9 required to place the security elements 8 at the desired relative distance x2 onto the carrier web 5 and subsequently under the desired number of labels 2.

Figure 2:
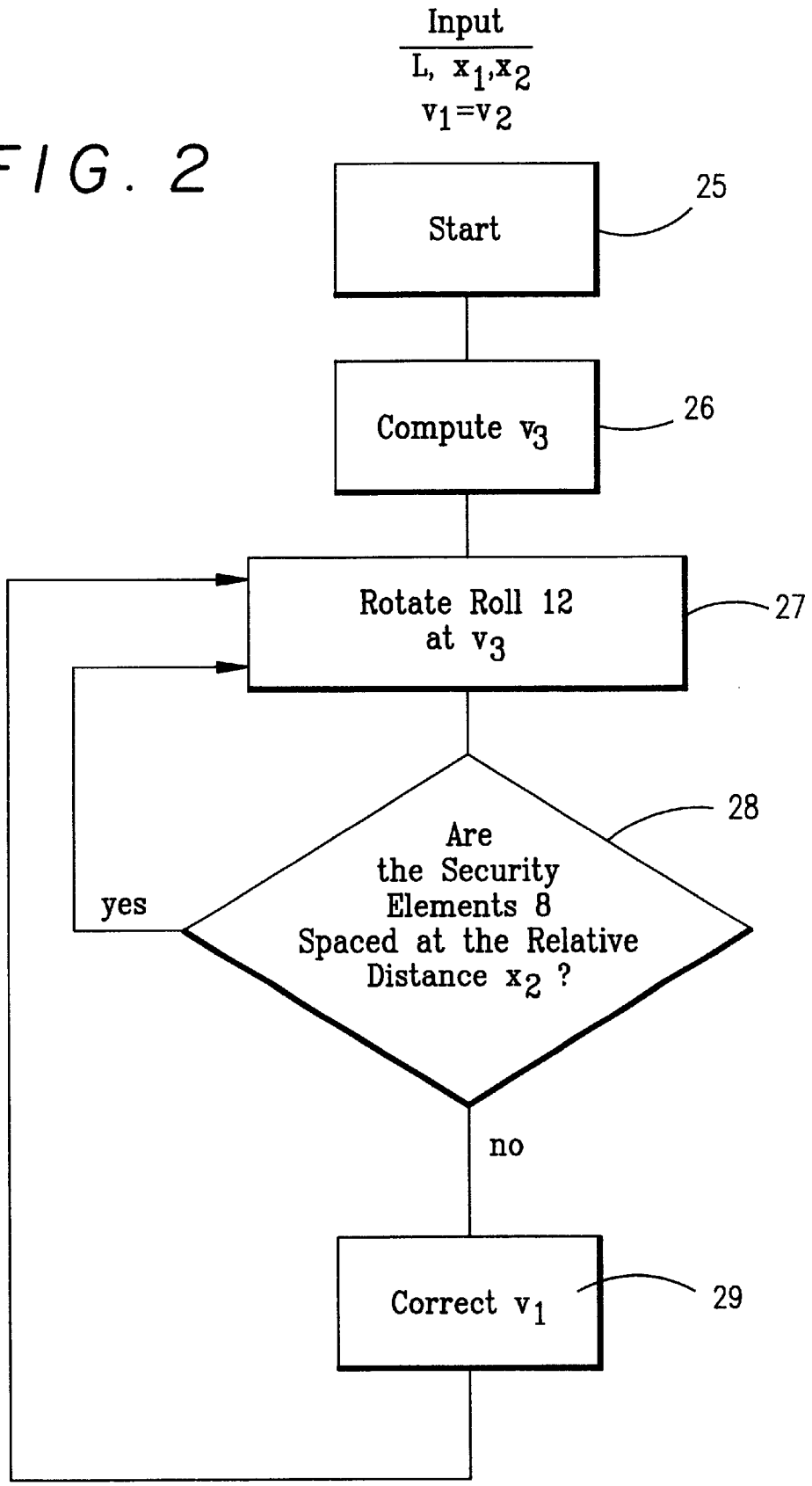
FIG. 2 is a flow diagram of the control process for the controlling/regulating device.

FIG. 2 shows a flow diagram of the control process for the controlling/regulating device 11. The controlling/regulating device 11 receives as input the measurement data for the length of a security element 8, the relative distance x1 of the security elements and the desired relative distance x2 at which the security elements 8 are to be arranged in relation to the labels 2. The controlling/regulating device 11 also receives data concerning the running speed v2. Preferably this running speed v2 corresponds to the peripheral speed v1 of the application cylinder 9.

The program for controlling the apparatus of the present invention is started at program point 25. At point 26 the controlling/regulating device 11 computes the peripheral speed v3 of the supply roll 12 using the predetermined measurement data and set data. At point 27 the supply roll 9 is caused to rotate with the aid of the angle transmitter 20 and the motor 22 at the computed peripheral speed v3. Shortly before the security elements 8 are transferred from the application cylinder 9 to the carrier web 5, the sensor 18 checks whether the security elements 8 are spaced at the desired relative distance x2 (program point 28). If the check confirms that the relative position of the security elements 8 is correct, the program returns in a loop to point 27. If a deviation from the required setpoint value x2 is discovered under program point 28, the peripheral speed v1 of the application cylinder 9 is corrected accordingly in point 29. The program ends when the desired number of labels 2 has been equipped with security elements.

What is claimed is:

1. A method for manufacturing labels for electronic article surveillance, comprising the steps of:

removing labels from their carrier web by means of a first dispensing edge;

placing the removed labels in a predetermined position on one of: the same carrier web, and a different carrier web by means of a second dispensing edge;

removing security elements from their carrier web by means of a further dispensing edge; and transferring said removed security elements continuously by an application cylinder to the carrier web of the labels, so that after the labels and their carrier web are laminated together, at least one security element is allocated to a desired number of labels.

2. An apparatus for manufacturing labels for electronic article surveillance, the labels being situated on a carrier web, comprising:

a label repositioner having a first dispensing edge and a second dispensing edge; and a first applicator unit for applying security elements to carrier webs, wherein said first dispensing edge removes labels from the carrier web, said second dispensing edge places the labels in a predetermined position on one of: the same and a different carrier web, and wherein said first applicator unit applies security elements continuously to the carrier web, whereby at least one security element is allocated to one of: each label and any number of labels.

3. The apparatus as defined in claim 2, further comprising:

a further applicator, wherein said applicator unit comprises the following sub-elements: an application cylinder using one of vacuum and magnets for operation.

4. The apparatus as defined in claim 2, further comprising:

a regulating/controlling device which insures that the security elements are positioned correctly in relation to the labels.

5. The apparatus as defined in claim 3, wherein said further applicator comprises the following sub-elements: a supply roll on which a carrier web supporting the security elements is wound; a dispensing edge over which the security elements are transferred to said application cylinder; and at least one sensor which detects the relative distance of the individual security elements.

6. The apparatus as defined in claim 5, further comprising:

an adhesive applied between the carrier web for the security elements and the security elements, whose adhesive force relative to the carrier web for the security elements is smaller than the force of attraction/suction exerted by said applicator cylinder.

7. The apparatus as defined in claim 2, further comprising:

a first sensor for detecting the relative distance of the labels on the carrier web for the labels;

a second sensor for detecting the relative distance of the security elements on the carrier web for the security elements; and a third sensor aligned with said application cylinder for detecting the relative distance of the security elements on said applicator cylinder.

8. The apparatus as defined in claim 4, wherein said controlling/regulating device adapts the peripheral speed of said applicator cylinder to the running speed of the carrier web for the labels.

9. The apparatus as defined in claim 5, wherein said controlling/regulating device sets the peripheral speed of said supply roll so that the security elements are put on said application cylinder at a desired relative distance and are then transferred to the carrier web of the labels to be subsequently placed under the predetermined number of labels.

10. The apparatus as defined in claim 5, further comprising:

an angel transmitter and a motor for each of said supply roll and said application cylinder.

11. The apparatus as defined in claim 5, wherein said controlling/regulating device sets the peripheral speed of said application cylinder so that the security elements are spaced at a predetermined relative distance on said applicator cylinder enabling them to be subsequently positioned under the desired number of labels.

* * * * *